US005974852A

United States Patent [19]

Nieschulz

[11] Patent Number: 5,974,852

[45] Date of Patent: Nov. 2, 1999

[54] LIFTER UNIT FOR TRANSFER DIE

[75] Inventor: Daniel F. Nieschulz, Macomb, Mich.

[73] Assignee: DaimlerChrysler Corporation, Auburn Hills, Mich.

[21] Appl. No.: 09/008,905

[22] Filed: Jan. 20, 1998

[51] Int. Cl.[6] ..... B21D 45/04

[52] U.S. Cl. ..... 72/427; 72/420; 267/71

[58] Field of Search ..... 72/427, 426, 420, 72/344, 345; 192/143, 138, 116.5; 267/71

[56] References Cited

U.S. PATENT DOCUMENTS 594,729 11/1897 Crosby ..... 267/71
2,957,667 10/1960 Kughler ..... 267/71
3,096,268 7/1963 Lindsay ..... 267/71
4,326,402 4/1982 Wallis ..... 72/420

*Primary Examiner*—Daniel C. Crane
*Attorney, Agent, or Firm*—Donna L. Berry

[57] ABSTRACT

A lifter unit is provided for use with a transfer die of the type used to form sheet metal components. The lifter unit functions to appropriately position a stamping between the upper and lower die assemblies and is easily accessible from the top of the lower die assembly. The lifter unit is fabricated from standard components and is readily adaptable to a wide range of transfer die designs. As such, the lifter unit of the present invention is a standardized item that can be quickly utilized by a die designer to provide a part positioning feature in a transfer die running in a transfer press.

13 Claims, 3 Drawing Sheets

LIFTER UNIT FOR TRANSFER DIE

TECHNICAL FIELD

This invention relates generally to a transfer die utilized to form sheet metal components, and more particularly to a lifter unit for a transfer die to lift a component part that is subsequently moved from die to die within the transfer press.

BACKGROUND OF THE INVENTION

Transfer dies are widely used in the stamping industry to perform various metal forming operations on sheet metal. More specifically, a metal component to be formed is inserted into a transfer die between a lower die assembly and an upper die assembly. Prior to the stamping operation, the stamping or part to be formed is located on a support plate which is operably coupled to a lifter unit. During the stamping operation, the upper die assembly is lowered onto the lower die assembly such that the part is stamped therebetween. The downward movement of the upper die assembly causes the support plate to move downwardly, thereby enabling the part to engage the lower die assembly. After the stamping operation is completed, the upper die assembly moves upwardly away from the lower die assembly and the part is raised to a position between the upper and lower die assemblies on the support plate.

Prior art transfer dies included a lifter unit having two distinct components, namely a lift pin cylinder supported on the lower die assembly for reciprocal movement and operably coupled to a transfer plate at an end opposite the support plate, and a spring assembly disposed between the lower die assembly and the transfer plate for biasing the lift pin cylinder away from the upper die assembly. Due to the positioning of these components, access to both the top and the bottom of the transfer die is required for installation and maintenance of the lifter unit. In addition, the transfer plate occupied additional space which creates the potential for interference during the operation of the transfer die. Moreover, each lifter unit had to be specifically designed for a particular transfer die due to variations in the dimensions of the lower die assembly.

SUMMARY OF THE INVENTION

The present invention is therefore directed to overcoming the disadvantages commonly associated with the prior art lifter units used in a transfer die. In accordance with the present invention, a preferred embodiment of a simplified lifter unit for the stamping industry is provided which is assembled using standardized parts. More specifically, the lifter unit of the present invention provides a single, spring-biased cylinder which is installed and accessed from the top of the lower die assembly of the transfer die. The lifter unit's standardized design and use of standardized components greatly reduces the time required to design and build a lifter unit for a transfer die, as well as greatly reduces the need for specialized components for the fabrication of such unit. Moreover, maintenance of a transfer die including the present invention is greatly simplified since the lifter unit is accessible from the top of the transfer die. Access to the lifter unit from above also makes the transfer die safer in that die makers installing and maintaining the transfer die do not have to position themselves beneath the die assembly.

A general object of the present invention is to provide a simple and low cost lifter unit for use in combination with a transfer die which is easy to manufacture and which enhances the performance of the transfer die.

Another object of the present invention is to provide a lifter unit which may be readily manufactured from standardized components which are generally off-the-shelf components or easily obtainable by the die maker.

A further object of the present invention is to provide a lifter unit which greatly reduces time and costs associated with the design, fabrication and maintenance of a transfer die.

These and other objects and advantages will become apparent when reference is made to the following drawings and accompanying description.

BEST MODE OF CARRYING OUT THE INVENTION

Figure 1:
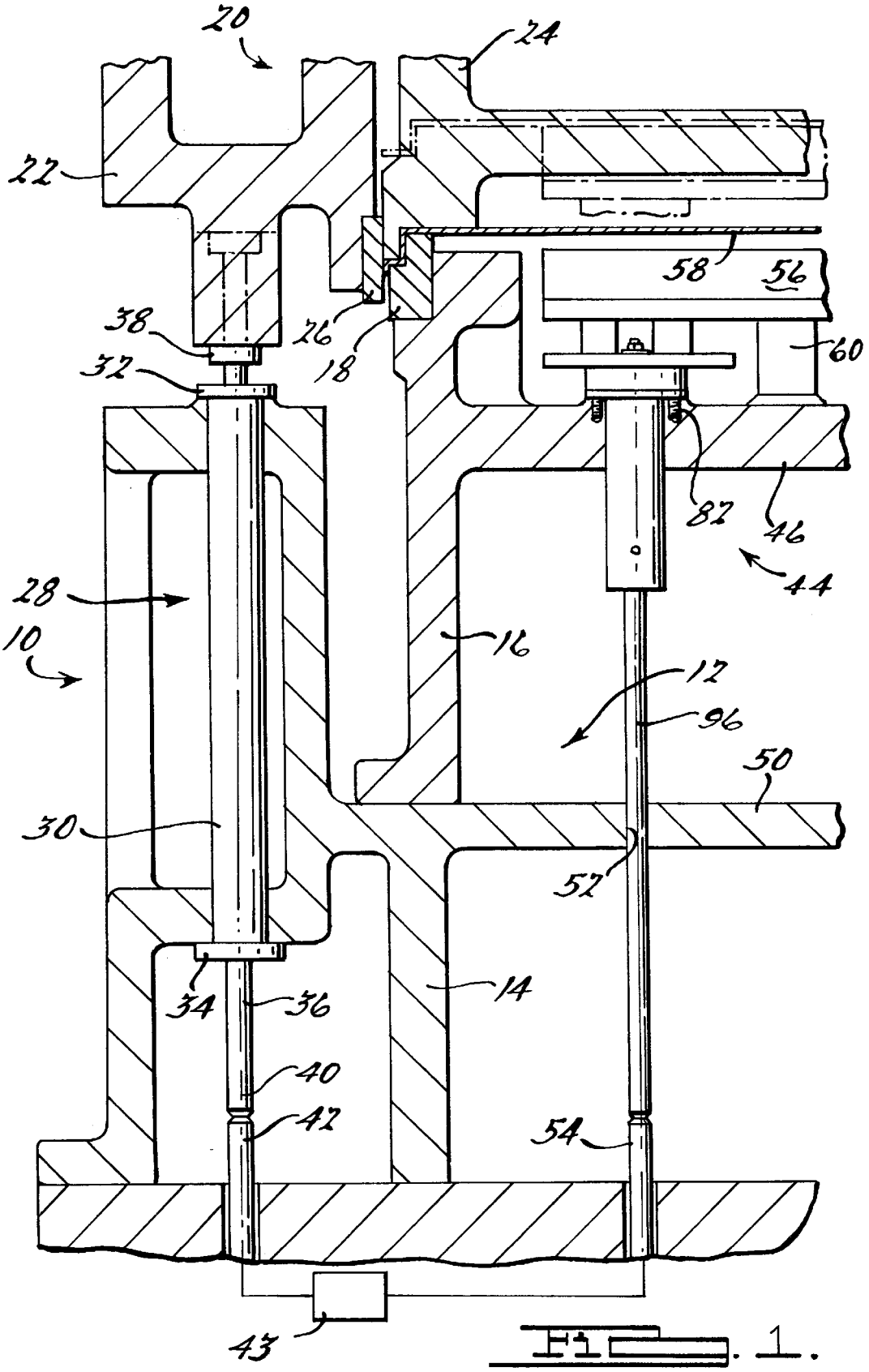
FIG. 1 is a partial cross-sectional view of a transfer die having the lifter unit of the present invention included therein.

Referring now to the drawings in greater detail, FIG. 1 illustrates a transfer die including a lower die assembly 12 having a lower shoe 14 supporting a lower post 16 which operably positions a lower die 18. Transfer die 10 further includes an upper die assembly 20 having upper shoe 22 and upper pad 24 which supports upper die 26.

A preceding pin assembly 28 is secured to and supported by lower die assembly 14 and is operably coupled to upper shoe 22 to affect vertical movement of upper die assembly 20 with respect to lower die assembly 12. More specifically, preceding pin assembly 28 includes cylinder 30 having upper and lower end caps 32, 34 disposed on opposite ends thereof and preceding pin 36 supported for reciprocal movement in cylinder 30. The upper end 38 of preceding pin 36 is positioned with respect to upper die assembly 22 and the lower end 40 is operably coupled to push pin 42. Push pin 42 is operably coupled to an air cushion 43 and generates an upward constant vertical force which urges preceding pin 36 upwardly, as the transfer die opens and upper die assembly 20 moves vertically upwardly away from lower die assembly 12.

Figure 2:
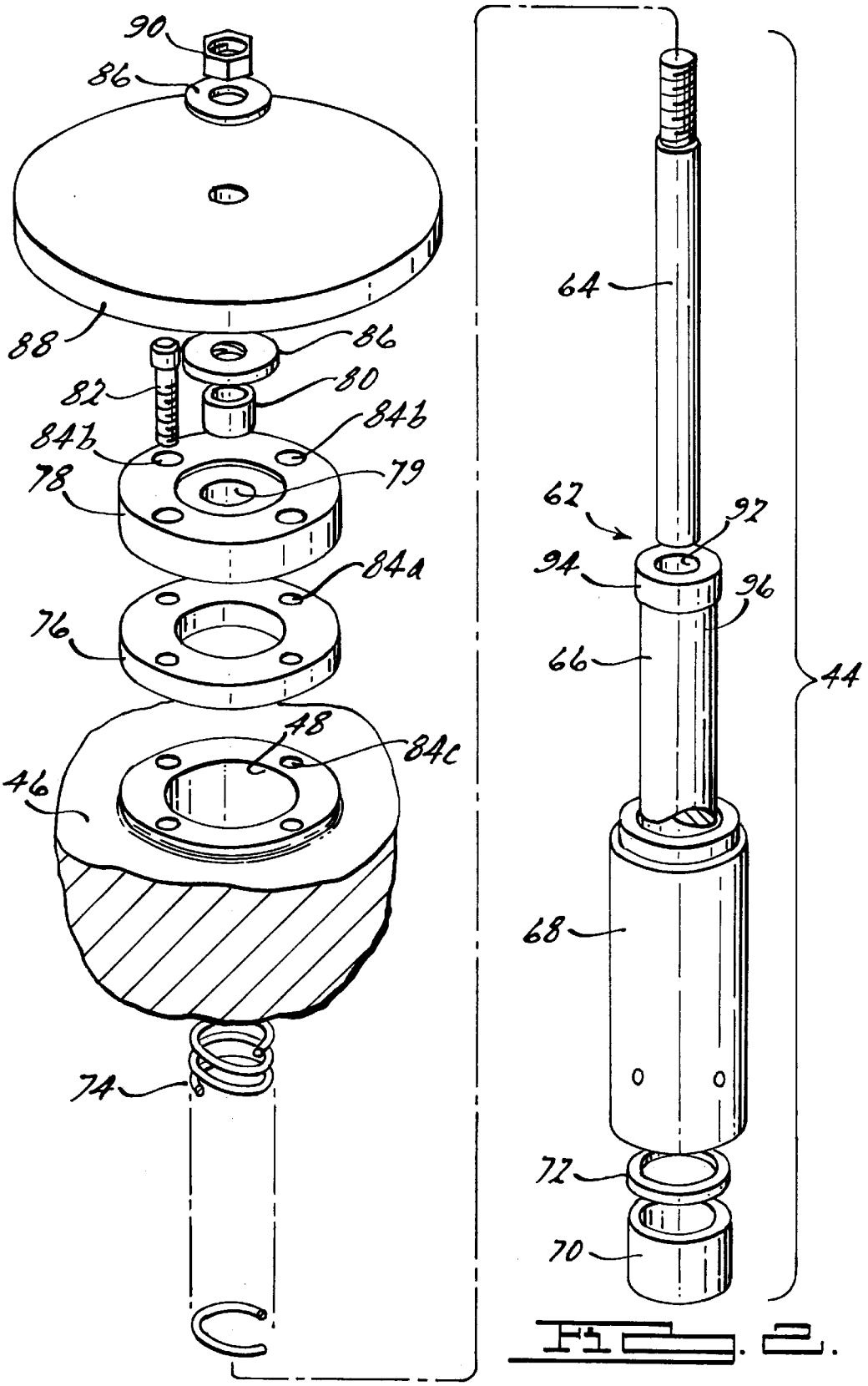
FIG. 2 is an exploded perspective view of the lifter unit illustrated in FIG. 1.

With additional reference to FIG. 2, transfer die 10 is shown to further includes lifter unit 44 secured to and supported by lower die assembly 16. More specifically, upper horizontal member 46 of lower die assembly 16 has a throughbore 48 formed therein which receives lifter unit 44. A plurality of threaded fasteners secure lifter unit 44 to horizontal member 46. Similarly, lower horizontal member 50 of lower die assembly 14 has throughbore 52 formed therein for providing a clearance hole to permit lifter unit 44 to extend downwardly. The end of lifter unit 44 opposite upper horizontal member 46 engages push pin 54 which is operably coupled to push pin 42 via the air cushion 43 for coordinated movement therewith. Support plate 56 is disposed on lifter unit 44 and provides a surface for positioning part 58 between lower and upper die assemblies 12, 20 during the lifting operation performed by lifter unit 44. Bumper block 60 extends upwardly from upper horizontal member 46 to engage a lower surface of support plate 56.

Figure 3:
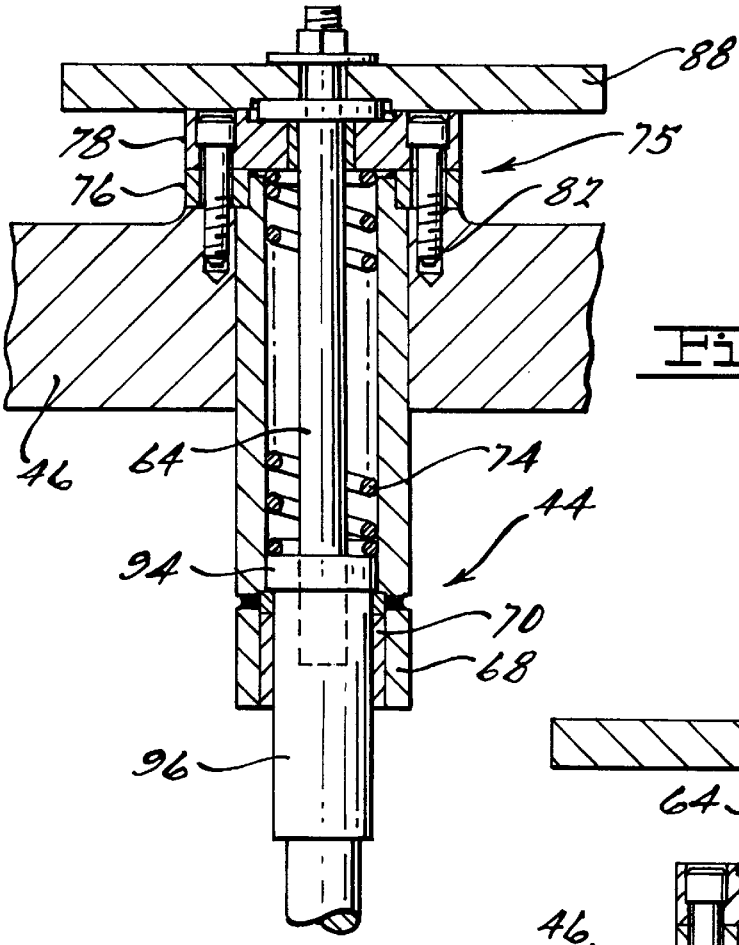
FIG. 3 is a partial cross-sectional view of the present invention showing the lifter unit in the down or die closed position.
Figure 4:
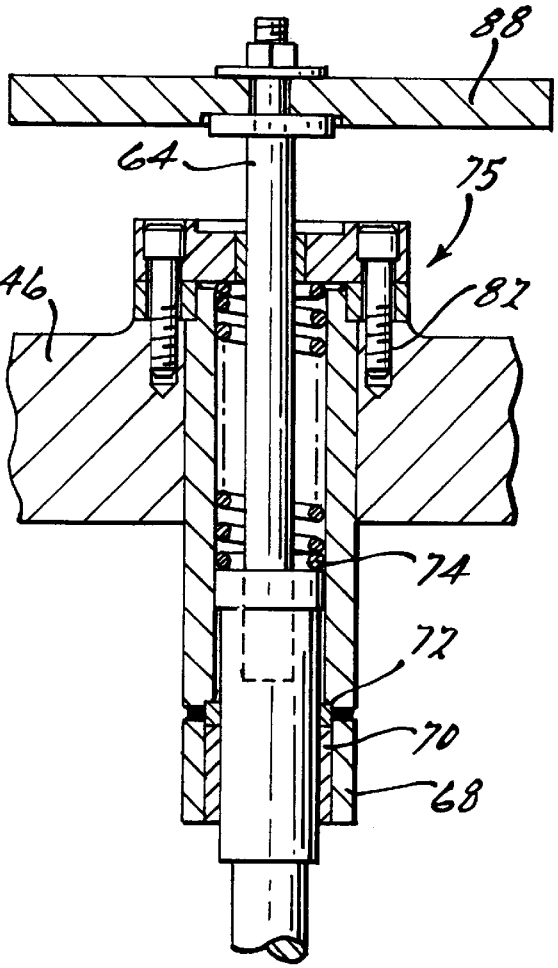
FIG. 4 is a partial cross-sectional view of the present invention showing the lifter unit in the up or die open condition.

Referring specifically to FIG. 2, the specific components of lifter unit 44 are illustrated. Lifter unit 44 includes rod assembly 62 having upper rod portion 64 and lower rod portion 66 which is supported within tubular housing 68 for a range of longitudinal motion. More specifically, lower bushing 70 is disposed within tubular housing 68 at a lower end thereof. As presently preferred, lower bushing 70 is a self-lubricating alum-bronze bushing which ensures that rod assembly 62 moves smoothly and accurately within tubular housing 68. A steel stop 72 is located above lower bushing 70 within tubular housing 68. As presently preferred, stop 72 is welded into place as best seen in FIGS. 3 and 4, however, stop 72 and tubular housing 68 could also be integrally formed. Stop 72 provides a positive mechanical stop for rod assembly 62 which prevents damage to lower bushing 70. In addition, stop 72 retains rod assembly 62 in tubular housing 68, thereby facilitating service of lifter unit 44 from the top of transfer die 10.

As shown in FIGS. 3 and 4, spring 74 is concentrically located about upper rod 64 and operably disposed between lower rod 66 and end cap assembly 75 within tubular housing 68. More specifically, end cap assembly 75 includes mounting flange 76 concentrically disposed around and welded to tubular housing 68. A lower surface of mounting flange 76 abuts upper horizontal member 46 to position lifter unit 44 in throughbore 48. Fastening plate 78 is disposed on top of mounting flange 76 and provides an upper spring seat for spring 74. Fastening plate 78 and mounting flange 76 are shown in the drawings having circular shapes; however, various other geometric shapes may also be implemented. The upper end of lower rod portion 66 provides a lower spring seat for spring 74. In this manner, spring 74 operates to bias rod assembly 62 in a downward direction. Upper bushing 80 is disposed within aperture 79 formed in fastening plate 78 and supports rod assembly 62 for longitudinal reciprocal motion. As presently preferred, upper bushing 80 is a self-lubricating alum-bronze bushing.

A plurality of threaded fasteners 82 extend through complimentary apertures 84*a*, 84*b* formed in mounting flange 76 and fastening plate 78 and are received in threaded apertures 84*c* formed in upper horizontal member 46 to secure lifter unit 44 to transfer die 10. In this way, lifter unit 44 is readily accessible from the top of lower assembly 12 for installation and maintenance.

The upper end of upper rod 64 extends through a pair of washers 86 and lifter plate 88 and receives nut 90. Lifter plate 88 provides increased surface area for securing support plate 56 to lifter unit 44. A cotter pin (not shown) may be used in conjunction with self-locking nut 90 to ensure that lifter plate 88 will not loosen or separate from lifter unit 44.

With continued reference to FIGS. 2–4, rod assembly 62 is shown to preferably be a multiple piece assembly. More specifically, upper rod 64 is received within blind bore 92 formed in the upper end of lower rod 66. Upper shoulder 94 is formed on lower rod 66 and engages stop 72 to limit the range of longitudinal motion of rod assembly 62. Bearing surface 96, which can vary in length, affixed to lower rod portion 66 below upper shoulder 94 and cooperates with lower bushing 70 to ensure that central rod assembly 62 moves in a smooth and accurate manner. Bearing surface 96 extends downwardly to operably couple lifter unit 44 with push pin 54. The length variations of bearing surface 96 accommodate variations in the distance between the upper end of push pin 56 and the mounting surface for lifter unit 44 defined by upper horizontal member 46.

Referring now to FIG. 1, a portion of transfer die 10 in the die open condition is illustrated in phantom lines such that support plate 56 and part 58 are positioned in an up or die open location between lower and upper die assemblies 12, 20. As upper assembly 20 moves downwardly causing preceding pin assembly 28 to compress air cushion 43, pins 42 and 54 move downwardly and lifter unit 44 lowers part 58. Further downward movement of upper assembly 20 causes upper die 26 to engage part 58, thereby performing the stamping operation. At the same time lifter unit 44 sufficiently lowers support plate 56 so as to disengage part 58.

After completion of the stamping operation, air cushion 43 urges push pins 42, 54 upwardly causing preceding pin assembly 28 and lifter unit 44 to move upwardly, (preceding pin assembly 28 positions upper die assembly 20 out of engagement with part 58), while lifter unit 44 moves part 58 out of engagement from lower die 18. At this point, part 58 is positioned between lower and upper dies 18, 26 by support plate 56 such that it may be removed from transfer die 10 for subsequent operation. While the present invention has been described in reference to a particular preferred embodiment, one skilled in the art would readily recognize that certain modifications could be made thereto without deviating from the scope of the present invention. For example, transfer dies utilized in the industry are particularly adapted for lifter units which accommodate two ranges of motion, namely a lifter unit providing a fifty (50) millimeter range of travel and a lifter unit providing a seventy-five (75) millimeter range of travel. One skilled in the art would readily recognize that the present invention can accommodate each of these ranges of travel, as well as other ranges of travel by modifying the lengths of the particular components associated therewith. More specifically, a greater range of travel may be provided by increasing the length of upper rod 64, tubular housing 68 and spring 74 to provide the desired range of travel.

INDUSTRIAL APPLICABILITY

It should be apparent that the present invention provides a simplified lifter unit for a transfer die. The simplified lifter unit is assembled from substantially standardized parts which reduces design, fabrication and installation time, as well as reduces the cost of the component. The lifter unit of the present invention also has additional safety benefits to transfer dies incorporating the present invention in that it is readily accessible from the top of the transfer die. While but one embodiment of the present invention has been shown and described, other modifications are possible within the scope of the following claims.

What is claimed:

1. A lifter unit for use in a transfer press for positioning a part therein, said lifter unit comprising:

a tubular housing;

an end cap assembly disposed at a first end of said tubular housing and adaptable to secure the lifter unit to a portion of the transfer press;

a stop disposed at a second end of said tubular housing;

a rod assembly supported for a range of longitudinal movement in said tubular housing, said rod assembly including an first portion having a first end extending through said end cap assembly, and a second portion having a first end with a blind bore formed therein for receiving a second end of said first portion and a second end extending through said stop;

a spring operatively disposed in said tubular housing between a first spring seat formed on said end cap assembly and a second spring seat formed on said second portion to bias said rod assembly.

2. The lifter unit of claim 1 wherein said end cap assembly comprises:

a mounting flange disposed on said first end of said tubular housing; and a fastening plate disposed on top of said mounting flange, said fastening plate having said spring seat formed thereon.

3. The lifter unit of claim 2 wherein said fastening plate further comprises an aperture formed therethrough for receiving a bushing to slidably support said first portion of said rod assembly.

4. The lifter unit of claim I wherein said stop is disposed within said tubular housing and said second portion of said rod assembly has a shoulder portion formed thereon for engaging said stop to limit said range of longitudinal movement of said rod assembly.

5. The lifter unit of claim 4 further comprising:

a bearing surface formed on said second portion of said rod assembly; and a bushing disposed within said tubular housing and engaging said bearing surface to slidably support said second portion of said rod assembly.

6. A transfer die for positioning and forming a stamping, the transfer die comprising:

a lower die assembly;

an upper die assembly;

a preceding pin assembly having a first push pin and a second push pin, said first push pin being selectively movable in a vertical direction and operably supported from said lower die, said second push pin coupled to said first push pin for coordinated movement therewith, said preceding pin assembly further including a preceding pin having a first end engaging said first push pin and a second end operably coupled to said upper die assembly to effect vertical movement thereof in response to movement of said first push pin;

a lifter unit for positioning a stamping between said upper and lower die assemblies, including:

a tubular housing disposed in a throughbore formed in said lower die assembly, said tubular housing having a mounting flange formed on a first end thereof to engage said lower die assembly and a fastener plate for securing said lifter unit to said lower die assembly;

a rod assembly extending through said tubular housing and supported for a range of longitudinal movement therein, said rod assembly having a first end operably coupled to said second push pin, a second end having a support plate extending therefrom for supporting said stamping; and a spring operative disposed in said tubular housing between a first spring seat formed on said fastener plate and a second spring seat formed on said rod assembly to bias said rod assembly.

7. The transfer die assembly of claim 6 wherein said fastening plate further comprises an aperture formed therethrough for receiving a bushing which engages said rod assembly for providing slidable support thereof.

8. The transfer die assembly of claim 6 wherein said lifter unit further comprises a lower bushing operably disposed within said tubular housing and engaging said rod assembly for providing slidable support thereof.

9. The transfer die assembly of claim 6 wherein said rod assembly is a two-piece component comprising an upper rod portion and a lower rod portion, said lower rod portion having a blind bore formed in a first end thereof for receiving a lower end of said upper rod portion.

10. The transfer die assembly of claim 6 wherein said lifter unit further comprises a stop disposed at a second end of said tubular housing opposite said first end.

11. The transfer die assembly of claim 10 wherein said lower rod portion further comprises a shoulder portion formed thereon for engaging said stop to limit said range of longitudinal movement of said rod assembly.

12. The transfer die assembly of claim 11 wherein said lifter unit further comprises:

a bearing surface formed on said lower rod portion of said rod assembly; and a bushing disposed within said tubular housing and engaging said bearing surface to slidably support said second portion of said rod assembly.

13. A lifter unit for a transfer press which utilizes a preceding pin assembly to open and close the transfer press and which further employs an automation mechanism for transferring a stamping formed in the transfer press from a first location to a second location, said lifter unit comprising:

a tubular housing having a first end and a second end;

a mounting flange having a centrally located aperture formed therethrough for receiving said first end of said tubular housing;

a fastener plate disposed on top of said mounting flange and having a centrally located aperture formed therethrough;

an upper bushing disposed in said central aperture of said fastener plate;

a lower bushing disposed within said tubular housing at said second end;

a stop disposed within said tubular housing between said lower and upper bearings;

a rod assembly supported for a range of longitudinal movement in said tubular housing, said rod assembly including an upper portion having a first end extending through said upper bearing to slidably support said rod assembly, a lower portion having a first end with a blind bore formed therein for receiving a second end of said upper portion, a shoulder portion engageable with said stop to limit said range of longitudinal movement of said rod assembly and a bearing surface engaging said bearing surface to slidably support said rod assembly, and an extension extending from said lower portion and terminating at a lower end which engages the preceding pin assembly of the transfer press; and a spring operatively disposed in said tubular housing between a first spring seat formed on fastener plate and a second spring seat formed on said lower portion of said rod assembly to bias said rod assembly.

* * * * *